United States Patent [19]

Butcher

[11] 4,122,977

[45] Oct. 31, 1978

[54] ACTUATORS FOR VALVES FOR PRESSURIZED DISPENSERS

[75] Inventor: Roger A. Butcher, Horndean, England

[73] Assignee: Aerosol Inventions & Development S.A. AIDSA, Fribourg, Switzerland

[21] Appl. No.: 765,393

[22] Filed: Feb. 3, 1977

[30] Foreign Application Priority Data

Feb. 13, 1976 [GB] United Kingdom ..... 5672/76

[51] Int. Cl.[2] ..... B65D 83/14

[52] U.S. Cl. ..... 222/182; 222/402.11; 222/402.22

[58] Field of Search ..... 222/153, 182, 402.11, 222/402.21, 402.22, 402.23

[56] References Cited

U.S. PATENT DOCUMENTS

| | | | |
|---|---|---|---|
| 3,048,307 | 8/1962 | Michel | 222/402.11 X |
| 3,318,492 | 5/1967 | Haas | 222/402.11 |
| 3,346,148 | 10/1967 | Weese | 222/402.11 |
| 3,926,349 | 12/1975 | Schultz | 222/402.22 |

FOREIGN PATENT DOCUMENTS

| | | | |
|---|---|---|---|
| 1,399,586 | 7/1975 | United Kingdom | 222/402.11 |

*Primary Examiner*—Robert B. Reeves
*Assistant Examiner*—Francis J. Bartuska
*Attorney, Agent, or Firm*—Scrivener, Parker, Scrivener & Clarke

[57] ABSTRACT

A tilt-type aerosol dispensing valve is made child-resistant by arranging that the actuating button is axially movable between a free position (in which it can be operated) and a locked position in which parts of the button engage part of the valve mounting to prevent tilting. For example the button may have a skirt which, in the locked position, fits over the central boss of the valve mounting cup. The overcap can be arranged to push the button to the locked position automatically as the overcap is applied.

2 Claims, 1 Drawing Figure

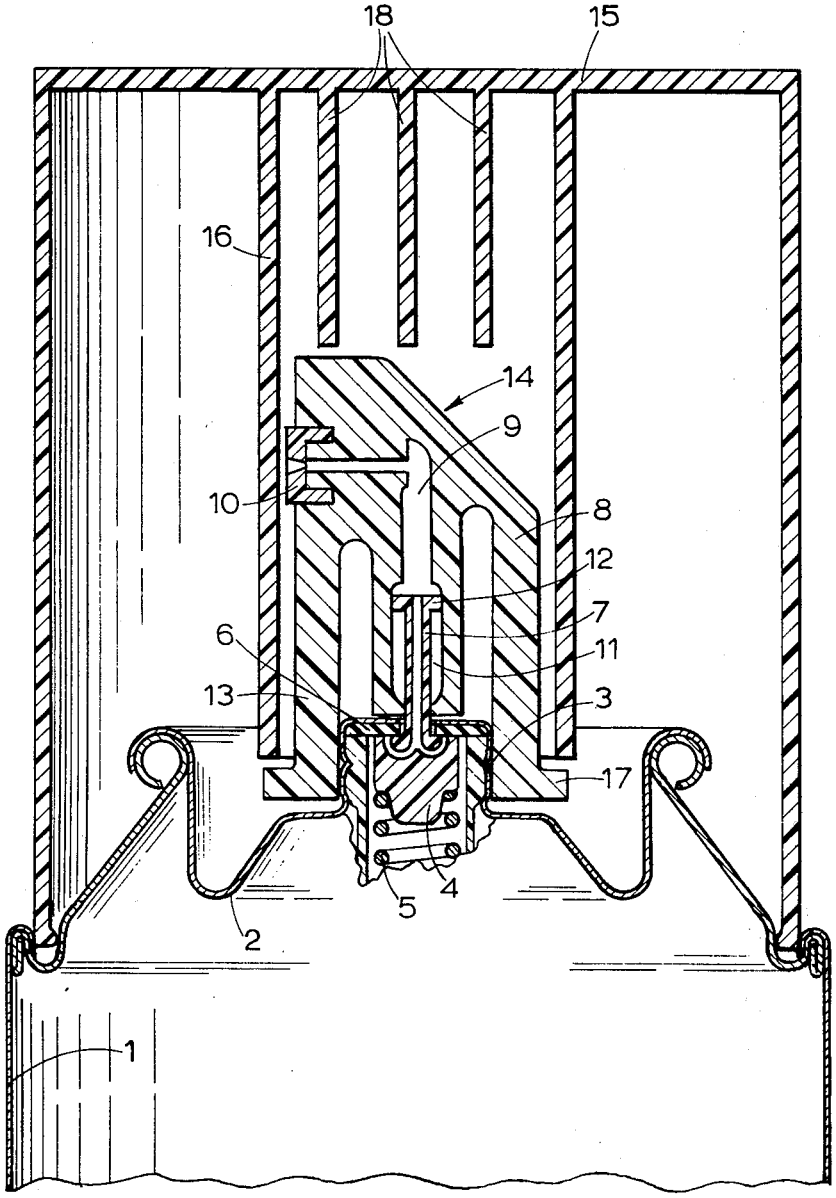
18
15
16
14
9
10
8
12
7
6
11
13
3
17
4
5
2
1

ACTUATORS FOR VALVES FOR PRESSURIZED DISPENSERS

SUMMARY OF THE INVENTION

This invention relates to actuators for valves for small hand-held pressurised dispensers of the kind often known as aerosol containers, although they frequently dispense products other than in aerosol form.

The most widely used forms of valve employ a hollow stem projecting upwards through a gasket and through a boss, which may be the centre boss of a sheet metal mounting cup. The stem carries an actuating button or spray tip with a nozzle through which the product emerges, this spray tip being pushed down or tilted to actuate the valve and dispense the product.

Various proposals have been made for rendering aerosol dispensers child-resistant, i.e. so that they cannot easily be used by a small child, with possible consequent danger or injury. The aim of the invention is to provide a valve assembly which achieves this in a simple manner.

According to the invention in a tilt-action valve assembly the spray tip or button is axially movable on the stem between an upper unlocked position in which it is free to allow normal operation of the valve and a lower locked position in which surfaces on the spray tip and on a fixed part of the valve mounting co-operate to prevent tilting.

In the simplest case it could be arranged that in the lower position the flat underside of the spray tip abuts against the top surface of the central boss of the mounting cup. However in a preferred version the spray tip has a downwardly extending skirt which is clear of the boss in the upper position but which, in the lower position of the tip, fits closely around the boss and prevents any substantial lateral movement sufficient to tilt and open the valve.

According to a further feature of the invention the spray tip described is used in conjunction with an overcap that automatically pushes the spray tip to the locked (lower) position as the overcap is fitted to the container. This may be done simply be an abutment surface on the underside of the top wall of the cap, engaging the top face of the spray tip. Alternatively, or in addition, the overcap may have an inner skirt which, as the overcap is replaced, fits over the spray tip and is of such a length that its lower edge engages an outwardly directed shoulder, bead or flange of the skirt on the spray tip, pushing the tip downwards to the locked position.

BRIEF DESCRIPTION OF THE DRAWING

The invention will now be further described by way of example with reference to the accompanying drawing, which is a vertical section through the upper end of a pressurised dispenser fitted with a spray tip or button according to the invention, and also with an overcap.

DESCRIPTION OF THE PREFERRED EMBODIMENT

The container 1 of the pressurised dispenser, which can be of the kind commonly known as an aerosol can, carries a standard pressed sheet metal valve mounting cup 2 of which the central boss 3 contains a known kind of tilt-action dispensing valve comprising a valve member 4 urged by a spring 5 into engagement with the underside of a gasket 6, and carrying a hollow stem 7 through which the product from the container 1 passes when the stem 7 is tilted to disengage one side of the valve member from the gasket.

In known valve assemblies the stem 7 carries a dispensing spray tip or button which is a friction fit on the stem and is axially fixed on it. In the valve assembly shown, however, a spray tip or button 8 is axially slidable on the stem to a limited extent. An axial passage 9 in the button 8, terminating in the usual lateral dispensing orifice with a spraying insert 10, has a widened portion 11 which co-operates with a flange 12 on the upper end of the stem 7, whilst the lower part of the passage co-operates with the shank of the stem, the dimensions being such that the button can slide up and down on the stem, against a certain amount of frictional resistance, through a distance limited by the length of the portion 11.

When the button 8 is in its lowest position, as shown in the drawing, the lower part of it, in the form of a skirt 13, fits over the central boss 3 of the valve mounting cup and prevents the button being tilted at all. This is thus the child-resistant position and is the position in which the button is normally left after use.

Only when the user first pulls the button axially upwards, so that its skirt 13 is clear of the boss 3, can he or she tilt the button sideways to open the valve and dispense the product. As is usual in buttons for tilt valves, the button 8 has a chamfered face 14 opposite to spraying orifice to indicate to the user the direction in which the button should be tilted.

To render the valve assembly child-resistant again after use, the user simply presses down axially in the button. In the example shown the downward travel is limited by the flange 12 engaging the mounting boss 3 itself, or the horizontal surface of the mounting cup 2 around this boss.

The container 1 may be fitted with the usual overcap to protect the button 8 when not in use but in the example shown this overcap, shown at 15, is of a special form, designed to force the button to the child-resistant position (if it is not already there) as the cap is put in place. For this purpose the overcap has a cylindrical inner skirt 16 of an axial length such that, when the outer skirt of the cap snaps into or onto the rim of the container 1 (in a manner which is well known and is not illustrated) the lower end of this inner skirt engages a bead 17 provided around the lower end of the button 8 and pushes the button to the child-resistant position.

The cap 15 also has ribs 18 depending from its upper wall to engage the top of the button.

The invention may be applied also to that kind of valve assembly in which the stem is integral with the button instead of with the valve member. In that case the relative axial sliding movement between the free and child-resistant positions would be between the stem and the valve member instead of the button and the stem.

I claim:

1. A pressurized dispenser comprising a container and a valve assembly carried by said container, said assembly comprising a valve member, a stem and an actuating button, said stem connecting said valve member to said button, a valve seating, a valve mounting receiving said seating, said valve member being normally sealed against said seating but, on tilting of said valve member by said button, allowing dispensing of a product through said stem and button, wherein said button is movable with respect to said valve member in a direction along the axis of said stem between a first position wherein said button is free to tilt, and a second position wherein co-operating surfaces on said button and said valve mounting prevent tilting of said button, said container further comprising a removable overcap, said overcap being adapted to fit onto said container to conceal said valve assembly, and co-operating surfaces on said overcap and said button whereby application of said overcap to said container causes, through said last-mentioned surfaces, displacement of said button from said first to said second position.

2. The container set forth in claim 1 wherein said co-operating surfaces of the overcap and button comprise the free edge of an internal skirt on said overcap and an external peripheral bead on said button.

* * * * *